US006131489A

United States Patent [19]

Yang

[11] Patent Number: 6,131,489

[45] Date of Patent: Oct. 17, 2000

[54] REVERSIBLE WRENCH

[76] Inventor: Chin-Chun Yang, No. 9, Lane 109, Tungmen Rd., East Dist., Taichung City, Taiwan

[21] Appl. No.: 09/440,660

[22] Filed: Nov. 16, 1999

[51] Int. Cl.[7] ..... B25B 13/00

[52] U.S. Cl. ..... 81/58.3; 81/473; 81/475; 81/58

[58] Field of Search ..... 81/473, 475, 58, 81/58.3, 58.4, 62, 63.1

[56] References Cited

U.S. PATENT DOCUMENTS 3,466,953 9/1969 Gegg .
5,737,982 4/1998 Lin .
5,775,184 7/1998 Cole .

*Primary Examiner*—Timothy V. Eley
*Assistant Examiner*—Willie Berry, Jr.
*Attorney, Agent, or Firm*—Rosenberg, Klein & Lee

[57] ABSTRACT

A reversible wrench, which includes a box body, an adapter mounted within the box body and supported on an inside annular flange in the box body, the adapter having a bottom coupling extended out the box body for holding a tool and a top ratchet, a driving block fastened to the box body on the inside above the adapter and stopped from rotary motion relative to the box body, the driving block having a bottom ratchet, which is forced into engagement with the ratchet at the adapter for enabling the adapter to be rotated with the driving block when the reversible wrench is attached to the workpiece and forced downwards, and a spring member connected between the adapter and the driving block to push the driving block apart from the adapter.

4 Claims, 4 Drawing Sheets

REVERSIBLE WRENCH

BACKGROUND OF THE INVENTION

The present invention relates to wrenches, and more particularly to a simple structure of reversible wrench, which runs idle when can easily be operated to rotate the workpiece clockwise or counter-clockwise as desired.

Various reversible wrenches have been disclosed, and have appeared on the market. These reversible wrenches run idle when turned in one direction, and rotate the workpiece positively when turned in the reversed direction. FIG. 1A shows a reversible wrench according to the prior art. This structure of reversible wrench comprises a box body 1 at one end of a handle, an internal gear 4 formed integral with the inside wall of the box body 1, an adapter 2 rotatably mounted in the box body 1 for holding a tool, for example, a socket, a switch a, and a stop block 3 controlled by the switch a to limit the direction of rotation of the adapter 2 relative to the box body 1. The toothed block 3 has two toothed portions 5 controlled by the switch a to engage with the internal gear 4 alternatively. FIG. 1A shows another structure of reversible wrench according to the prior art. This structure of reversible wrench comprises a box body 6 at one end of a handle, a an adapter 7 rotatably mounted in the box body 6 for holding a tool, the adapter 7 having a toothed shaft 8 suspended inside the box body 6, a switch b, a stop block 9 controlled by the switch b to limit the direction of rotation of the adapter 7 relative to the box body 6. The stop block 9 has two toothed portions 90 controlled by the switch b to engage the toothed shaft 8 alternatively. The aforesaid prior art reversible wrenches have drawbacks. The common drawback of these prior art reversible wrenches is their complicated structure. Another drawback of these prior art reversible wrenches is their complicated operation procedure. When changing the driving direction of the wrench, the engagement between the stop block 3 or 9 and the internal gear 4 or toothed shaft 8 must be shifted by means of the control of the switch a or b. Furthermore, the limited engaging area between one toothed portion 5 or 90 of the stop block 3 or 9 and the internal gear 4 or toothed shaft 8 is unstable, and the stop block 3 or 9 may slip on the internal gear 4 or toothed shaft 8 when rotating the wrench.

SUMMARY OF THE INVENTION

It is one object of the present invention to provide a reversible wrench, which is durable in use. It is another object of the present invention to provide a reversible wrench, which can easily be operated to change the driving direction. It is still another object of the present invention to provide a reversible wrench, which produces little noise when operated. According to one aspect of the present invention, the reversible wrench comprises a box body, an adapter mounted within the box body and supported on an inside annular flange in the box body, the adapter having a bottom coupling extended out the box body for holding a tool and a top ratchet, a driving block fastened to the box body on the inside above the adapter and stopped from rotary motion relative to the box body, the driving block having a bottom ratchet, which is forced into engagement with the ratchet at the adapter for enabling the adapter to be rotated with the driving block when the reversible wrench is attached to the workpiece and forced downwards, and a spring member connected between the adapter and the driving block to push the driving block apart from the adapter. According to another aspect of the present invention, when the reversible wrench is pressed downward on the workpiece, the bottom ratchet of the driving block is forced into engagement with the top ratchet of the adapter, enabling the adapter to be turned with the driving block and the box body to rotate the workpiece clockwise or counter-clockwise as desired. When the downward pressure is released from the reversible wrench, the driving block is forced away from the adapter, enabling the driving block to be turned with the box body relative to the adapter and the workpiece in either direction.

DETAILED DESCRIPTION OF THE DRAWINGS

Figure 1A:
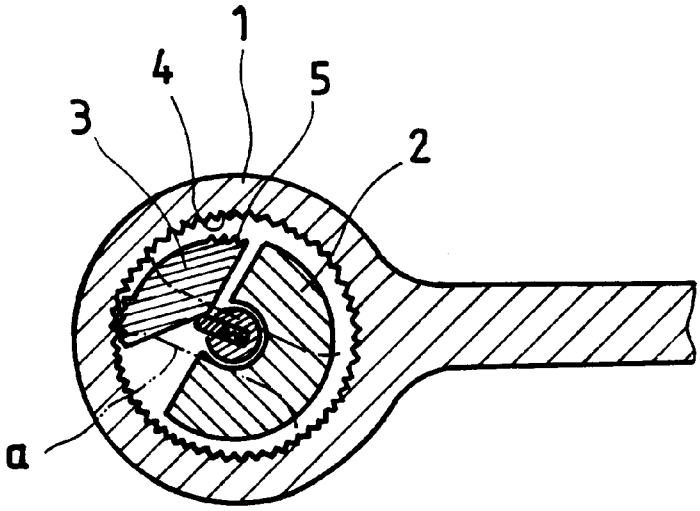
FIG.1A PRIOR ART
FIG. 1A is a sectional view of a reversible wrench according to the prior art.
Figure 1B:
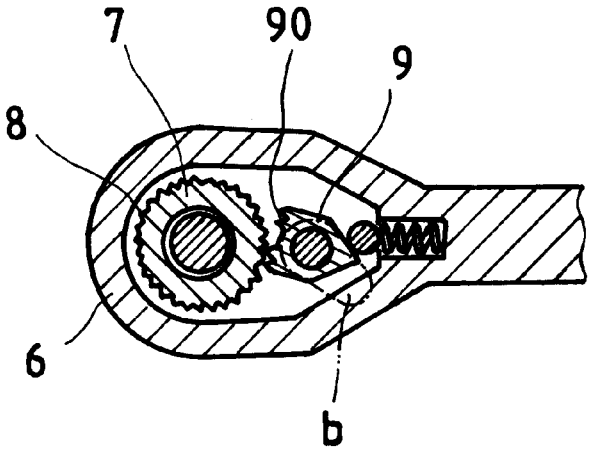
FIG.1B PRIOR ART
FIG. 1B is a sectional view of another structure of reversible wrench according to the prior art.
Figure 2:
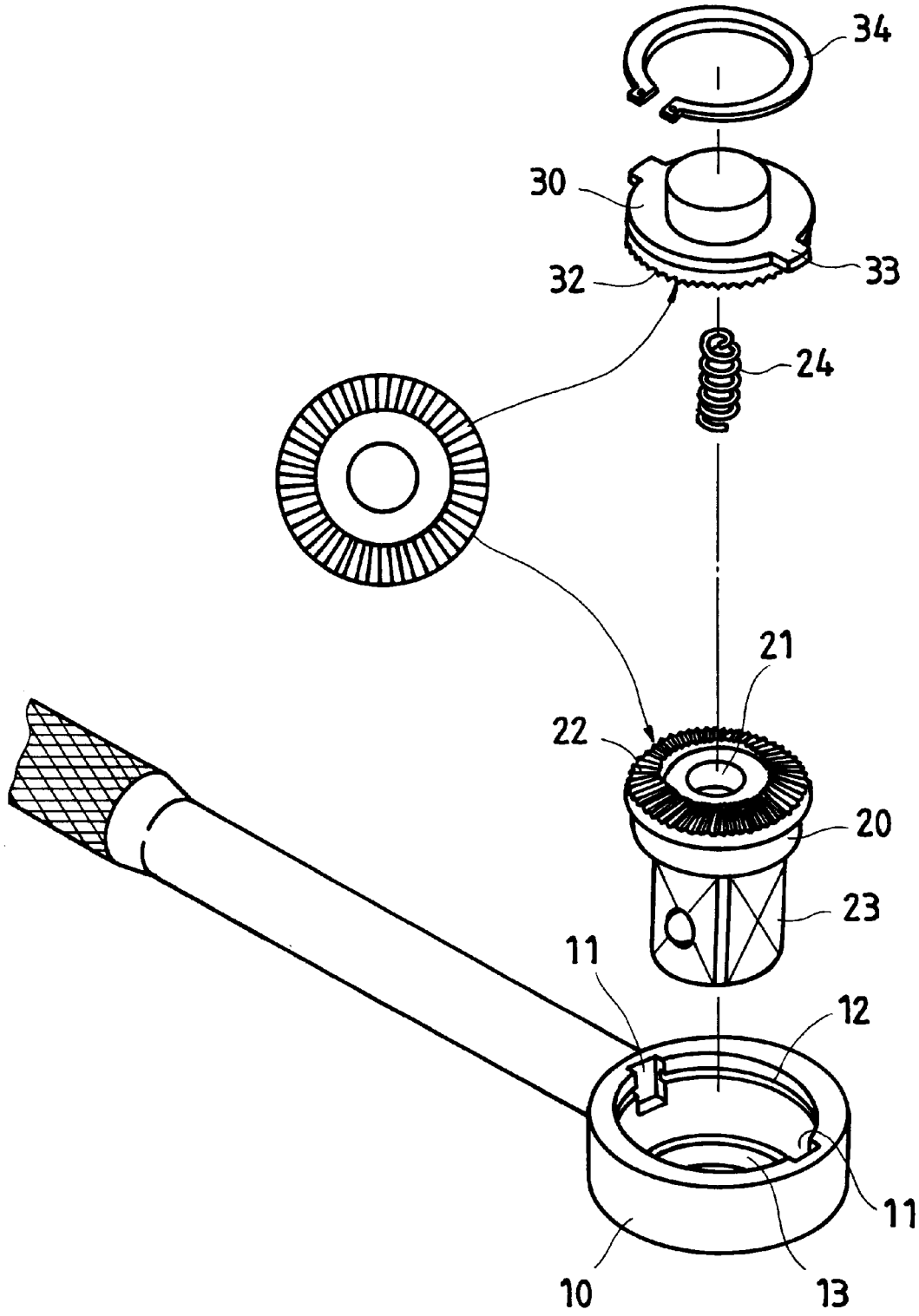
FIG. 2 is an exploded view of a reversible wrench according to one embodiment of the present invention.
Figure 3A:
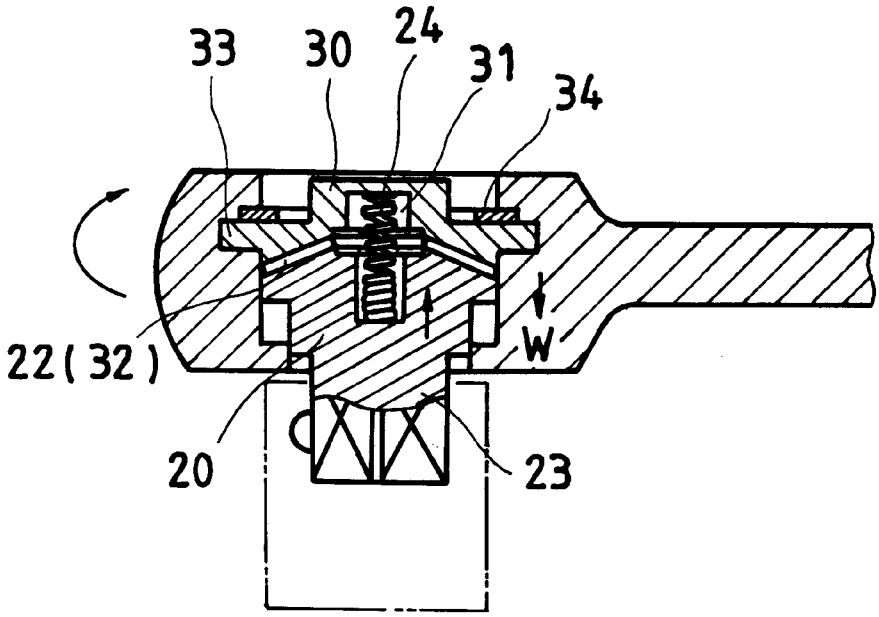
FIG. 3A is a sectional view showing clockwise rotation of the reversible wrench according to the present invention.
Figure 3B:
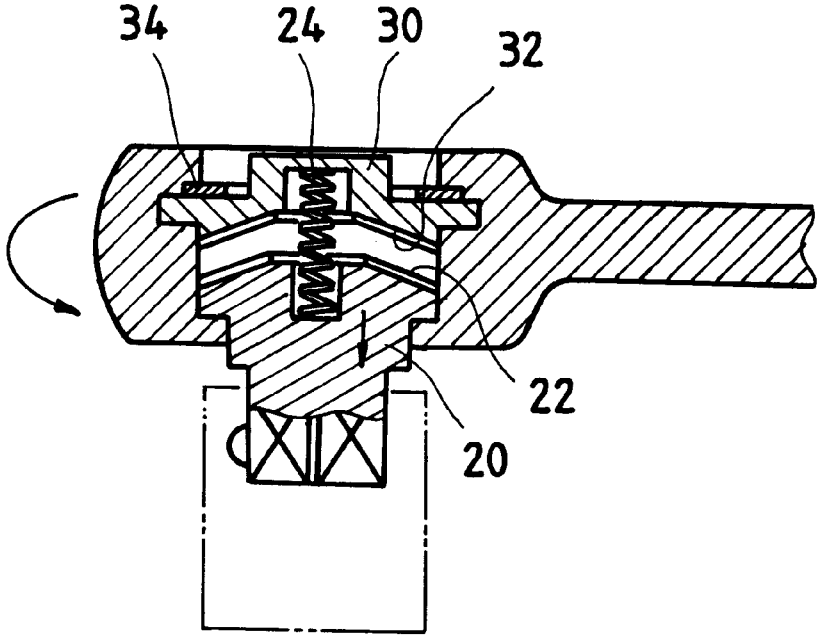
FIG. 3B is a sectional view showing counter-clockwise rotation of the reversible wrench.

Referring to FIGS. 2, 3A and 3B, a reversible wrench in accordance with the present invention is shown comprising a box body 10, an adapter 20, a driving block 30, a spring 24, and a C-clamp 34.

The box body 10 comprises an inside annular flange 13 raised around the inside wall thereof at one side, namely, the bottom side thereof, an inside annular groove 12 disposed on the inside wall and spaced above the inside annular flange 13, and a plurality of locating notches 11 symmetrically formed on the inside wall. The adapter 20 is mounted within the box body 10 and supported on the inside annular flange 13, comprising a bottom coupling 23 extended out of the bottom side wall of the box body 10 for holding a tool (for example, a socket), a ratchet 22 formed integral with the top side wall thereof, and a recessed top center hole 21 disposed at the center of the ratchet wheel 22. The spring 24 is inserted into the recessed top center hole 21 on the adapter 20. The driving block 30 is mounted within the box body 10 and supported on the spring 24, comprising a plurality of locating rods 33 symmetrically raised from the periphery thereof and respectively engaged into the locating notches 11 in the box body 10, a ratchet 32 formed integral with the bottom side wall thereof for engagement with the ratchet 22 at the adapter 20, and a recessed bottom center hole 31 disposed at the center of the bottom side wall thereof, which receives the top end of the spring 24. The C-clamp 34 is mounted around the periphery of the driving block 30 and fastened to the inside annular groove 12 in the box body 10 to secure the driving block 30 and the box body 10 together. Because the locating rods 33 are respectively engaged into the locating notches 11 in the box body 10, the adapter 20 is prohibited from rotary motion relative to the box body 10. Further, the spring 24 imparts a downward pressure to the adapter 20, causing the adapter 20 to be disengaged from the driving block 30.

Referring to FIGS. 3A and 3B again, when the reversible wrench is attached to the workpiece (for example, a screw bolt), a downward pressure W is applied to the box body 10 against the workpiece, causing the spring 24 to be compressed and, the ratchet 32 to be moved with the driving block 30 into engagement with the ratchet 22 at the adapter 20. At this stage, the reversible wrench is turned with the hand to rotate the workpiece clockwise. When the downward pressure W is released from the reversible wrench, the driving block 30 is immediately pushed upwardly away from the adapter 20, enabling the driving block 30 to be turned counter-clockwise with the box body 10 relative to the adapter 20 and the workpiece, i.e., the reversible wrench runs idle. By means of repeating the aforesaid procedure, the workpiece is quickly installed or dismantled. Because the engagement between the adapter 20 and the driving block 30 is achieved by means of the ratchets 22,32, driving power can positively be transmitted from the driving block 30 to the workpiece through the adapter 20. Further, the assembly process of the present invention is simple. When the adapter 20, the spring 24 and the driving block 30 are inserted into the box body 10, the C-clamp 34 is installed in the box body 10 to secure the adapter 20, the spring 24, the driving block 30 and the box body 10 together.

Figure 4:
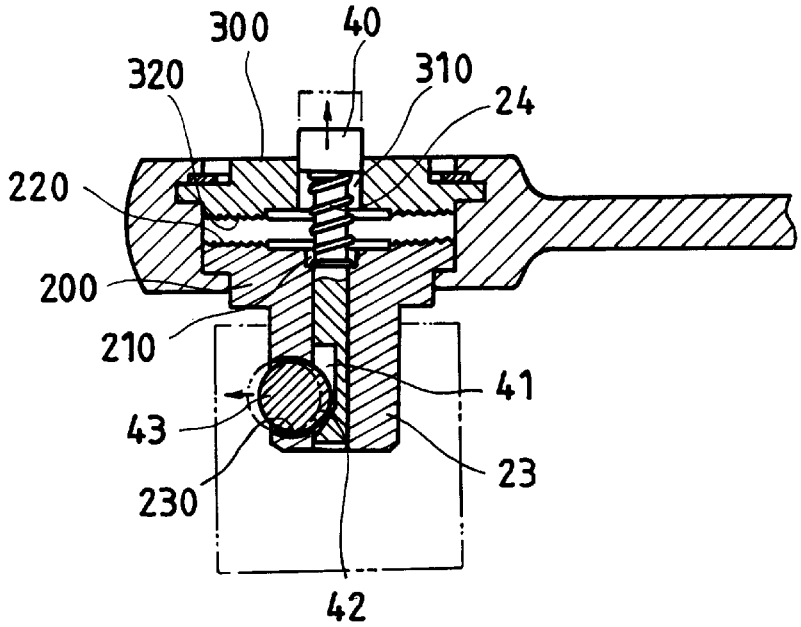
FIG. 4 is a sectional view of an alternate form of the present invention.

FIG. 4 shows an alternate form of the present invention. According to this alternate form, the driving block 300 comprises radial teeth 320 at the bottom side wall thereof and a center through hole 310, the adapter 200 comprises radial teeth 220 at the top side wall thereof for engagement with the radial teeth 320 at the driving block 300 and a center through hole 210, a pin 40 is inserted through the center through hole 310 on the driving block 300 and the center through hole 210 on the adapter 200, the spring 24 is mounted around the pin 40 and stopped between the driving block 300 and the adapter 200, and a steel ball 43 is mounted in a radial through hole 230 on the coupling 23 of the adapter 200. The pin 40 comprises a peripheral notch 41 for receiving the steel ball 43, and a sloping surface 23 at the bottom side of the peripheral notch 41. When the pin 40 is depressed, the steel ball 43 is moved into the peripheral notch 41, enabling the coupling 23 of the adapter 200 to be freely inserted into the tool (for example, the socket). After insertion of the coupling 23 into the tool, the pin 40 is released from the hand and pushed upwards by the spring 24, causing the steel ball 43 to be forced outwards by the sloping wall 42 of the pin 40 into engagement with the tool, and therefore the tool is secured to the coupling 23 of the adapter 200.

Figure 5A:
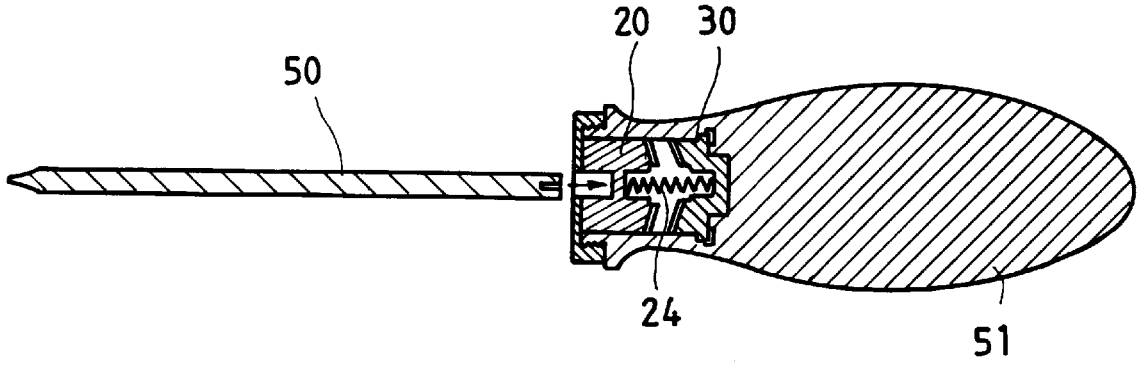
FIG. 5A is a sectional view of another alternate form of the present invention.
Figure 5B:
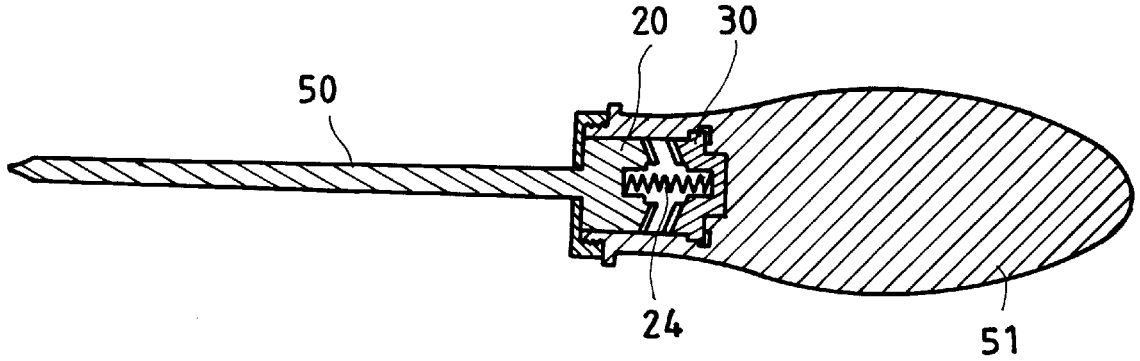
FIG. 5B is a sectional view of still another alternate form of the present invention.

FIGS. 5A and 5B, the present invention can be employed to a screwdriver. The aforesaid box body is formed integral with one end of a handle 51 to hold the adapter 20, the spring 24 and the driving block 30, and a screwdriver blade 50 is coupled to the adapter 20 (See FIG. 5A) or formed integral with the adapter 20 (see FIG. 5B).

It is to be understood that the drawings are designed for purposes of illustration only, and are not intended as a definition of the limits and scope of the invention disclosed.

What the invention claimed is:

1. A reversible wrench comprising:

a box body, said box body comprising an inside annular flange raised around an inside wall thereof at a bottom side, an inside annular groove disposed on the inside wall and spaced above said inside annular flange, and a plurality of locating notches symmetrically formed on the inside wall;

an adapter mounted within said box body and supported on said inside annular flange, said adapter comprising a bottom coupling extended out of said box body for holding a tool, and radial teeth formed integral with a top side wall thereof;

a driving block mounted within said box body, said driving block comprising a plurality of locating rods symmetrically raised from the periphery thereof and respectively engaged into the locating notches in said box body, and a plurality of radial teeth formed integral with a bottom side wall thereof for engagement with the radial teeth at said adapter;

a C-clamp mounted around the periphery of said driving block and fastened to the inside annular groove in said box body to secure said driving block and said box body together; and a spring member connected between said adapter and said driving block to push said driving block apart from said adapter.

2. The reversible wrench of claim 1 wherein the radial teeth of said adapter and the radial teeth of said driving block respectively slope downwardly.

3. The reversible wrench of claim 1 further comprising a quick-release locking mechanism for enabling a tool to be secured to the coupling of said adapter, said quick-release locking mechanism comprising a pin inserted through a center through hole on said driving block and a center through hole on said adapter, said pin comprising a peripheral notch and a sloping wall at a bottom side of said peripheral notch, and a steel ball moved in a radial through hole on the coupling of said adapter between an unlocking position where said pin is lowered in said driving block and said adapter to compress said spring and said steel ball is received in the peripheral notch on said pin, and a locking position where said pin is pushed upwards by said spring and said steel ball is forced outwards by the sloping wall of said pin into engagement with the tool being attached to the coupling of said adapter.

4. The reversible wrench of claim 1 wherein said box body is formed integral with one end of a handle, and the coupling of said adapter holds a screwdriver blade.

* * * * *